US005655836A

United States Patent [19]

Preston et al.

[11] Patent Number: 5,655,836

[45] Date of Patent: Aug. 12, 1997

[54] DUAL ACTION SHAKER TABLE USING PARALLELOGRAM LINKAGES

[75] Inventors: Philip K. Preston, Winnetka; Troy W. Livingston, Northbrook, both of Ill.

[73] Assignee: Preston Industries, Inc., Niles, Ill.

[21] Appl. No.: 522,846

[22] Filed: Sep. 1, 1995

[51] Int. Cl.[6] ..... B01F 11/00

[52] U.S. Cl. ..... 366/208

[58] Field of Search ..... 366/110–114, 208–216, 366/219

[56] References Cited

U.S. PATENT DOCUMENTS

| | | | |
|---|---|---|---|
| 342,336 | 5/1886 | Curtis . | |
| 1,020,344 | 3/1912 | Clauson . | |
| 2,539,851 | 1/1951 | Massey . | |
| 2,793,010 | 5/1957 | Menken . | |
| 2,828,949 | 4/1958 | Paladino et al. . | |
| 2,829,528 | 4/1958 | Hulick, Jr. . | |
| 3,159,384 | 12/1964 | Davis . | |
| 3,224,737 | 12/1965 | Becker | 366/208 |
| 3,788,611 | 1/1974 | Barbini | 366/208 |
| 4,183,677 | 1/1980 | de Bruyne . | |
| 5,259,672 | 11/1993 | Rowe . | |

*Primary Examiner*—Charles E. Cooley

*Attorney, Agent, or Firm*—Lockwood, Alex, Fitzgibbon & Cummings

[57] ABSTRACT

A dual action shaker table useful in permitting various modes of shaking the objects. The shaker table provides either a substantially reciprocating shaker motion or a true rotary shaker motion using two cooperating parallelogram linkage constructions in cooperation with a drive link and a driving mechanism. Switching between these two modes of operation is carried out by removably affixing a part of one link or a part of another link to the table.

11 Claims, 3 Drawing Sheets

DUAL ACTION SHAKER TABLE USING PARALLELOGRAM LINKAGES

BACKGROUND OF THE INVENTION

The present invention relates generally to what are termed shaker tables or platforms, and in particular, to a new and improved dual action shaker platform.

By the expression "shaker table" as used herein is meant the provision of a surface that may undergo a shaking motion that is useful for shaking specimens disposed upon the platform, or, in other embodiments, to shake laboratory specimens or other containers in a holder of some sort that, whether proximate or remote from the shaker table, undergoes the same motion.

Thus, in some instances, it is desired to shake specimens retained in test tubes, flasks, or the like by resting them on a table which directly holds the specimens. In other instances, the table is positioned in a certain location and attachments thereto, such as peripheral stanchions or the like, are used to support a specimen holder that may be disposed in a temperature controlled liquid bath, for example. In this instance, the table may lie beneath the housing for the bath and permit the specimens to be immersed in a bath but, by appropriately positioning the supporting stanchions so that the specimen holder is suspended from the open top of the bath, there is no need to provide fluid seal with respect to the bath contents.

Among the desired features of the satisfactory shaker apparatus are control of speed, amplitude, and, in some cases very importantly, the mode of shaking.

While various kinds of shaker tables or platforms are known to the art, there is and has been a need for an improved, mechanically simple and highly adaptable shaker platform arrangement, particularly one that could be manufactured at low cost and which is very readily convertible from one shaking mode to the other.

While various mechanical and direct drive electrical arrangements are available to impart an oscillating motion of one sort or another to a batch of specimens or the like, there has been a need for an improved shaker table which will provide either a substantially straight line or back and forth shaker motion or a true rotary shaker motion, and to be convertible between these modes of operation by a simple, foolproof manipulation.

There has also been a need for a shaker platform drive arrangement wherein the shaker mechanism is readily adjustable both as to stroke length and to mode of operation, and is furthermore adaptable to positioning a load carrier in a variety of ways without changing the underlying part of the apparatus. There is further need in the laboratory or scientific community for an apparatus which is constructed and arranged so that the load bearing parts will be durable in use and hence provide long-term economy.

In view of the failure of the prior art to provide a dual mode shaker table or platform of optimum design, it is an object of the present invention to provide an improved shaker table arrangement.

Another object of the invention is to provide a shaker platform arrangement that may support a load directly or somewhat indirectly, depending on the desired application.

Still another object of the invention is to provide an apparatus wherein shifting or converting the apparatus from the reciprocating cycle to a rotary cycle is capable of being carried out with a change to only a single part or element.

A further object of the invention is to provide a shaker platform arrangement having a drive mechanism which is equally effective regardless of stroke length.

A still further object of the invention is to provide a shaker platform that is able to be controlled in respect to three variables and which is free from maintenance-intensive elements and which is comparatively simple and reliable in use.

Yet another object of the invention is to provide a shaker table or platform in which the vertical load imposed by the components and the live load or articles to be shaken is taken by elements that are independent of the elements supplying the shaking motion.

Another object of the invention is to provide a shaker table mechanism wherein two sets of parallelogram linkages are present, one linkage including a pair of links mounted to a base and also to one portion of an intermediate or idler member forming a fourth link, and wherein the second linkage comprises links attached to another part of the intermediate or idler member and also to the table, with one set of links permitting motion in one direction and the second set of links permitting motion in a second, perpendicular direction, with the actual motion being determined by the form connection between the table and a rotary crank pin, or between the table and another link element.

An additional object of the invention is to provide two sets of parallelogram linkages in a shaker table, with a first set of links pivoting relative to the unit base and the other set of links pivoting with respect to a plate or L-member carried by the first set of links, and with a drive link and one of the second links each including an extension which may be removably secured to a portion of the table to determine the shaking mode desired.

Yet another object of the invention is to provide a shaker table of the type described herein wherein the stroke length adjustment is readily made by swinging the crank pin carrier through an arc relative to the center line of the drive element to obtain an increased or decreased stroke length of the crank pin.

According to the invention, an arrangement of links and plates is provided to permit the choice of a primarily reciprocating or a rotating motion of the shaker table. The table is supported at plural, spaced apart points by universal joints or the like permitting free but limited movement of the table under the influence of the drive mechanism. The drive mechanism includes a motor and a rotary element having a crank pin affixed thereto and optionally arranged so as to permit variation in the stroke of the crank pin.

An important feature of the invention is that the type of motion transmitted by the drive link to the table is determined by the manner in which a portion of one link or the other is secured to the table. In one mode, the drive link is not only rigid in itself, but is attached to the table at two points along its length. Accordingly, with the drive connection being affixed to the crank pin, the table will replicate the rotary motion of the crank pin. In this mode, the links permit such two-axis motion without allowing the table to turn about its own axis.

In the other mode of operation, the drive link is pivotally connected to both the crank pin and the table, allowing its free end (the end opposite the crank pin end) of the drive link to swing freely. In this mode, the second set of links cannot pivot relative to the table, but the first set of links allows a reciprocating motion along an axis determined by the location of the fixed pivots for the links.

The invention achieves its objects and advantages and other inherent objects and advantages by providing a base unit, a shaker table supported on the base unit, a motor drive arrangement including a rotary crank pin and a drive link with one end attachable to the crank pin, an opposite end fixable to the table and a center portion pivotally attached to the table, first and second sets of parallelogram-forming links, the first set permitting movement parallel to a first line or locus and the second set permitting movement parallel to a second locus perpendicular to the first line, and an auxiliary mechanism for selectively connecting the table to the drive link at either the opposite end of the drive link or an extension of one of the second pair of links. The objects are also achieved by providing an apparatus of the type just described that includes preferred forms of table support, stroke length adjustment and variation of shaker speed to provide improved versatility and reliability in use.

The exact manner in which the foregoing and other objects and advantages of the invention are achieved in practice will become more clearly apparent when reference is made to the following detailed description of the preferred embodiment of the invention set forth by way of example and shown in the accompanying drawings in which like reference numbers indicate corresponding parts throughout.

DESCRIPTION OF THE PREFERRED EMBODIMENTS OF THE INVENTION

While the inventive principles are able to be adapted to a number of different structures, a preferred form of the invention will be described wherein the shaker table is of generally inverted T-shaped configuration and wherein the links are of simple form, with an idler or like unit connecting the two pairs of parallelogram-forming legs being of an L-shaped configuration. A number of variations to the described form of apparatus will occur to those skilled in the art.

Figure 1:
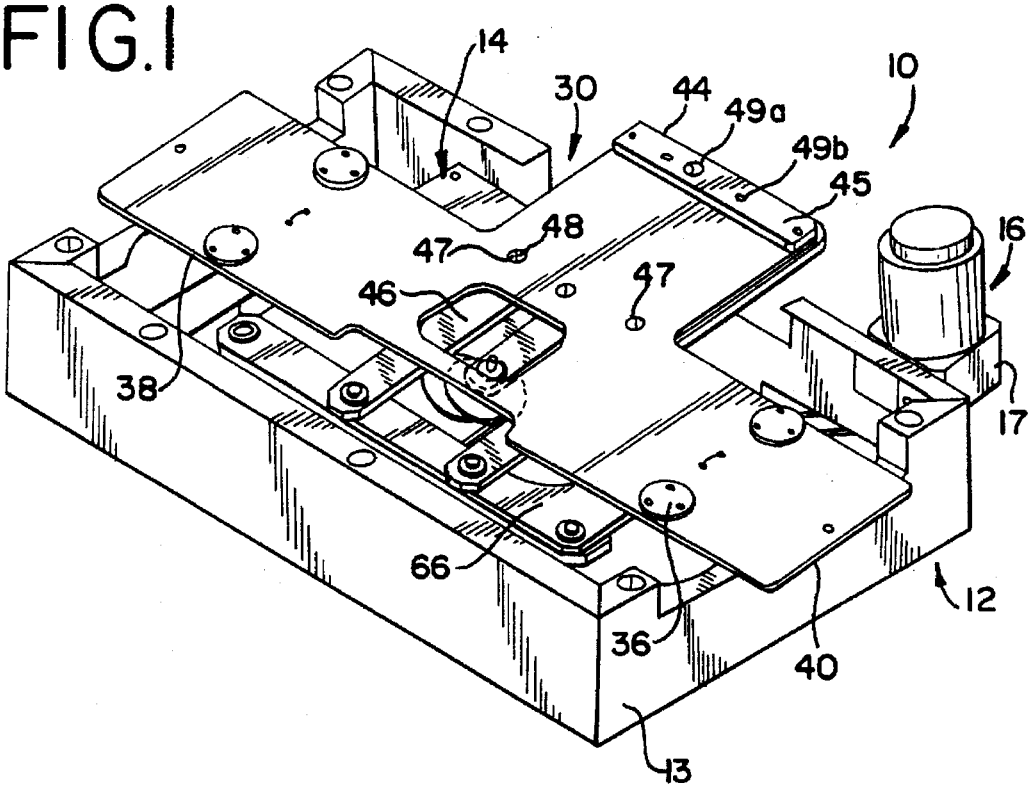
FIG. 1 is a perspective view showing the principal elements of the shaker table made according to the invention in a typical position of use.
Figure 3:
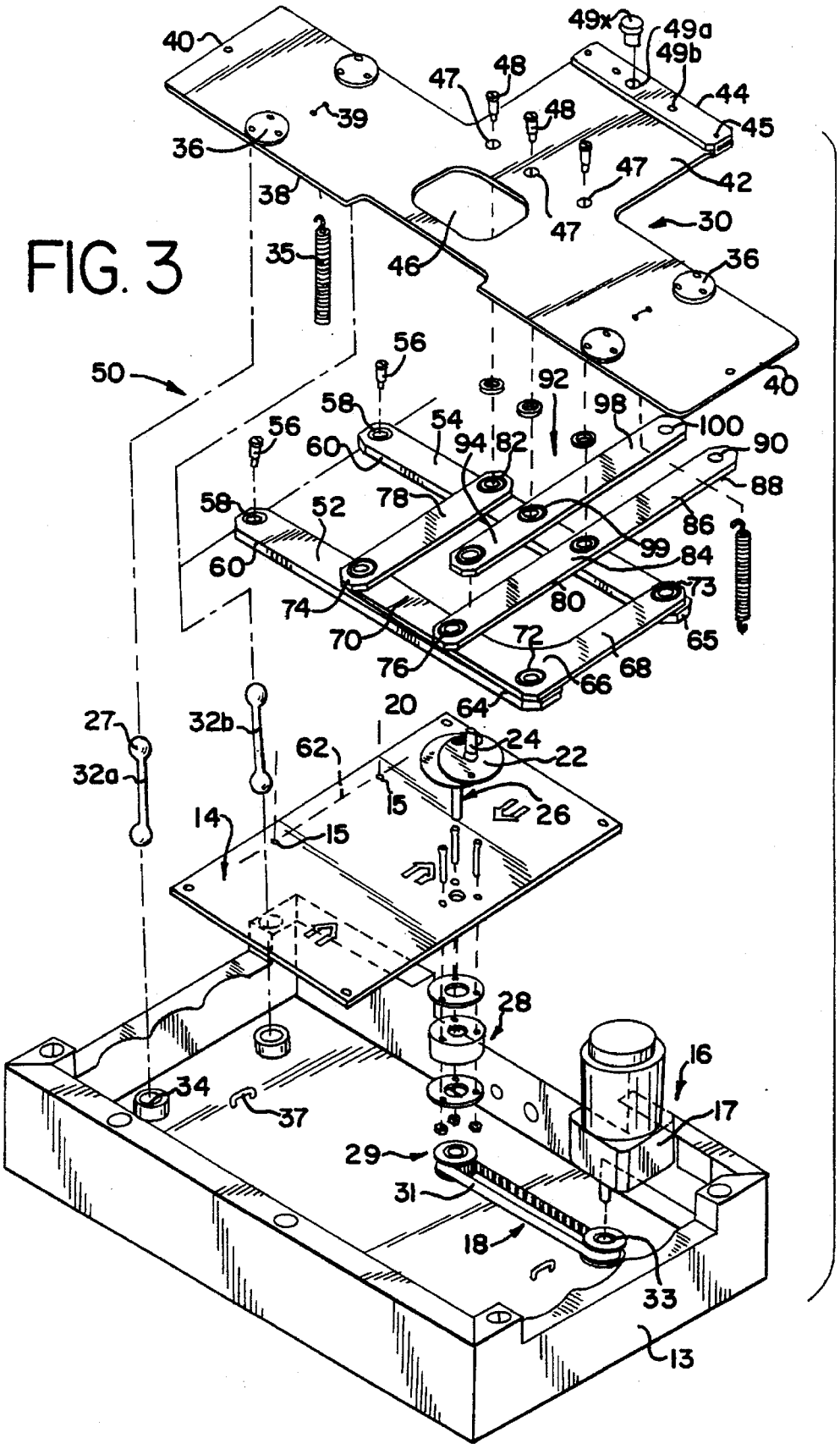
FIG. 3 is an exploded perspective view of a slightly modified form of the shaker table of FIGS. 1 and 2, showing the principal elements of the drive and motion control arrangement of the table of FIG. 1.

Referring now to the drawings in greater detail, FIGS. 1 and 3 show a shaker table apparatus generally designated 10 and shown to comprise a housing generally designated 12 that is adapted to contain a base plate 14 (FIG. 3) for controlling motion of the table. A motor generally designated 16 is equipped with a drive connection generally designated 18 that is operatively associated with a rotary drive plate 20, surmounted by an eccentric crank pin carrier 22 from which a crank pin generally designated 24 extends axially outwardly, i.e., upwardly as shown in FIG. 3.

Preferably, a rotary drive shaft 26 extends through portions of a bearing assembly generally designated 28 for connection to a driven sprocket 29 operated by a toothed or "Gilmer" belt 31 trained around a rotary, motor driven drive sprocket 33.

Referring again to FIGS. 1–3, an important feature of the invention is the shaker table generally designated 30 and shown to be, in this embodiment, of a generally inverted T-shape. The table may be of any shape, and may hold specimens to be shaken, or may be associated with any one of a number of specimen holders as desired by the user. The major portion of the weight of the shaker table 30 is normally borne by four mounting legs, 32*a*, 32*b*, etc., each of which includes an enlarged ball end 27 that is receivable in a leg mounting socket 34 positioned on the bottom panel of the housing 12. The shaker table 30 also includes leg mounting sockets positioned by socket holders 36 removably secured to the upper surface of the table 30. Tensioning springs 35 extend between the housing 12 and the shaker table 30, with spring retainers 37 being provided in the floor of the housing 12 and slots 39 being provided in the shaker table 30 for this purpose. Support of the table is also provided in part by the drive and movement control components to be described.

Figure 2:
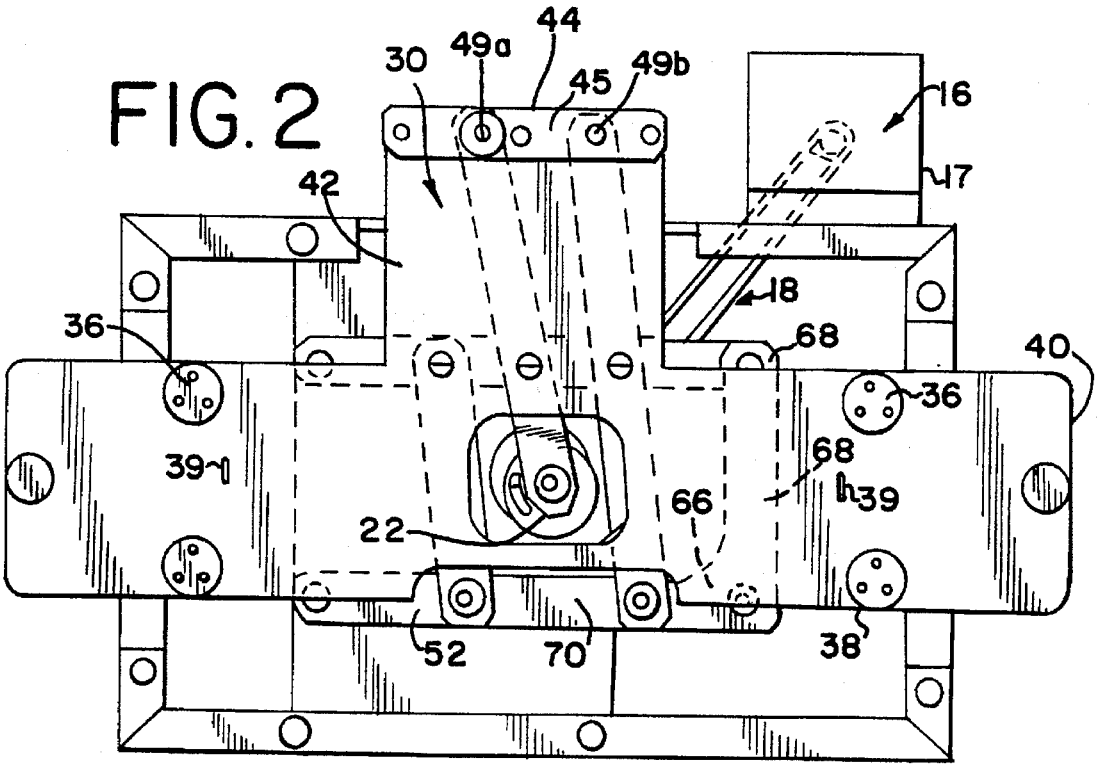
FIG. 2 is a top plan view of the shaker table of FIG. 1, showing the same arranged for a circular shaking motion.

Referring now to the table, as particularly shown in FIGS. 1–3, this element is of generally inverted T-shaped configuration and includes a full length edge 38, a pair of opposed side edges 40, an offset or stem portion of the "T" 42, an offset end edge 44 which may be stiffened with a reinforcing plate 45. An adjustment access port 46 is provided in the cross bar portion of the "T" or main section of the table 30. As is further shown in the above figures, there are plural openings 47 arrayed in a generally straight line perpendicular to the edges 40 to permit insertion of shoulder screws 48 therethrough. These openings 47 are preferably in a straight line arrangement parallel to the edges 38, 44 and perpendicular to the table side edge 40. The openings 49*a*, 49*b* for another or mode control shoulder fastener 49*x* extend through the reinforcing plate 45 and are also aligned parallel to the edges 38, 44.

Referring now to another principal component of the invention, a multi-link assembly generally designated 50, when properly connected to the motor and drive mechanism and also to the shaker table, accounts for the desired motion of the shaker table 30. This multi-link assembly 50 includes a first parallelogram linkage formed by first and second links 52, 54, pivotally held in position relative to openings 15 in the base plate 14 by shoulder screws 56 that extend through bushing style fittings 58 at the inner ends 60 of the links 52, 54. The screws 56 and openings 15 for receiving them are aligned along a reference locus 62 (FIG. 3). Preferably, this locus is parallel to the sides 13 of the housing 12, and the end edges 40 of the table 30.

Because the subject mechanism involves parallel linkages, this locus 62 is sometimes referred to herein and in the claims as a "first axis" or a "first locus". While the end and side edges of the table, the housing, and other elements need not come before functional purposes, be parallel or perpendicular to this locus, such components normally are for simplicity and neatness. The motions in question take place with respect to this first locus and a second locus lying perpendicular to it and to be referred to elsewhere herein.

The outer ends 64, 65 of the first and second links 52, 54 are pivotally mounted to an idler plate 66 which is preferably L-shaped and preferably has a first, shorter leg 68 parallel to the locus 62 and a second, longer leg 70 perpendicular to the locus 62. A pair of fasteners 72, 73 form pivotable connections permitting the edge of the shorter leg 68 to move toward and away from the front wall 17 of the housing 12, parallel to locus 62. In this arrangement, depending on the position of the two links 52, 54, a rectangle or a parallelogram is formed by opposed parallels, i.e., the locus 62 and the link 68, and the links 52, 54.

As shown in FIG. 3, the longer link 70 serves as a base for a second parallelogram linkage. This leg 70 locates the near ends 74, 76 respectively of table positioner links 78, 80. Spaced apart portions 82, 84 of the legs 78, 80 contain bushed openings for receiving the shoulder screw fasteners 48 extending downwardly through the plate 30. A locus connecting these openings 47 lies perpendicular to locus 62 and parallel to link 70.

Accordingly, when the apparatus 10 is assembled, the table 30 is pivotally fixed to parallel, spaced apart portions of the links 78, 80 which are in turn carried at the leg 70 of the plate or L-member 66. With this arrangement, the table forms the fourth link of a second rectangle or parallelogram.

Because the leg 70 is fixed perpendicular to the leg 68 of the plate or L-member 66, the loci of the two parallelogram linkages are perpendicular to each other.

Further, according to the invention, the link 80 is provided with an extension 86, the end portion 88 of which includes a tapped opening 90 which, in use, is registrable with the opening **49*b* in the plate 45. The fastener 49*x* can thus secure the table 30 to an end 88 of the link 80**.

The multi-link assembly 50 is completed by the addition of a drive link generally designated 92. This link includes a connecting rod portion 94 having a bushed, crank pin receiving end 96 and which also includes a rod or link extension 98 terminating in a tapped end opening 100. This opening 100 is registrable with the opening **49*a* in the plate 45, and the fastener 49*x*** can be used to secure these parts together.

Thus, as will be amplified further herein, this arrangement of two parallelogram linkages, one leg of an idler plate serves as a ling lying on a first locus, and the other leg of the idler plate forms a second locus perpendicular to the first locus.

Figure 4:
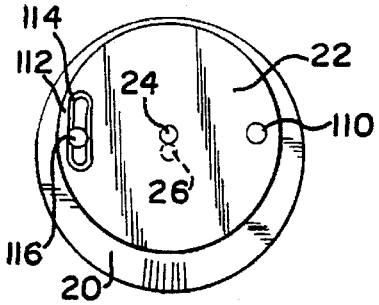
FIG. 4 is a top plan view of the adjustable crank pin arrangement of the invention.
Figure 5:
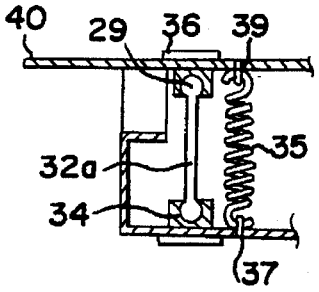
FIG. 5 is an enlarged fragmentary view of a portion of the table support mechanism of the invention.

Referring now to another feature of the invention, which is an optional but desirable feature in a shaker table, the stroke or extent of table movement may be readily achieved by the use of an eccentric crank pin arrangement. For this purpose, reference is made to FIG. 4, wherein it is shown that the rotary drive plate 20 includes an eccentric crank pin carrier 22 positioning the crank pin 24. The crank pin carrier 22 is pivotally connected to the drive plate 20 as by a fastener 110. The side of the carrier 22 opposite the fastener contains an elongated slot 112, preferably having a beveled upper surface 114, of arcuate oval configuration.

A tapered head set screw 116 is positionable within the slot and received in a tapped opening (not shown) in the plate 20. By loosening the locking screw 116 and swinging the carrier 22 through an arc about the point 110, the position of the crank pin carrier 24 will be moved relative to the center line of the drive shaft 26, which is shown as a base circle in phantom lines in FIG. 4. According to the invention, the links and the table, including the opening 46 in the table 30, are arranged to lie above the adjustment mechanism so that the working stroke of the device may be changed at any time without removing the table or the links.

Referring now to FIGS. 1 and 3, it will be noted that in these respective figures, the motor generally designated 16 is positioned atop a drive housing 17 which is shown in FIG. 1 as being behind the main housing 12 and within such housing in FIG. 3. These are detailed variations of the invention which are considered optional with the designer. Likewise, the arrangement of the Gilmer or toothed-belt drive arrangement is an optional but presently preferred manner of providing smooth power delivery and accessibility for service of these components. Needless to say, different sprocket arrangements or change in gearing or mechanical advantage may be attended to in a simple manner using different sprocket pairs with the toothed belt or the like.

In a preferred form of the invention, the motor drive is a variable speed drive of a known type and not forming a necessary part of the invention. Such motor speed control are known by those skilled in the art to be available for instruments and machines such as that described herein, and it is assumed that, to the extent that incorporating such variable speed controls is desired, this may be accomplished without the exercise of inventive skill.

Referring now to the operation of the apparatus of the present invention, and the principles behind such operation, an explanation of the operation of the invention is believed helpful. While the invention does not depend for its success on any particular theory or mode of operation, it is believed most easily understood by reference to an explanation of the geometry provided by the mechanism providing two associated parallelogram linkages.

According to geometrical principles, in a parallelogram formed by links pivotally joined at their ends, two opposed sides of the parallelogram will remain parallel to each other during pivotal movement of the other two parallelogram legs, which also stays parallel to each other. Accordingly, a side, which may be termed the "first" side of the leg 68 will remain parallel to the locus 62 extending between openings 15, 15. Such a leg 68 may swing back and forth, as legs 52, 54 pivot, but the leg 68 will always remain parallel to a line, such as the line or locus 62 connecting the pivot points of the links supporting it. Where one side of a rigid member remains parallel to a given reference surface, a portion of that same member which lies perpendicular to the reference surface will also remain perpendicular to the reference surface. In other words, legs 68, 70 of L-member 66 are always perpendicular to each other, and parallel and perpendicular respectively to locus 62.

According to the invention, therefore a second pair of links 78, 80 is attached to the second leg 70 of the idler plate or L-member. A parallelogram is formed by these two links, combined with the leg 70 and a portion of the table 30, as occurs when the fasteners 48 are positioned in the openings 82. Then, the table is permitted to move parallel to the edge 40, by one linkage and parallel to the edges 38, 44 by the other linkage.

According to the invention, the drive link and the leg extension are alternately affixed to a portion of the table to secure the desired drive mode, and the act of affixing one leg extension while releasing the other enables a first mode of operation, while affixing the other leg enables the second mode.

Accordingly, when the fastener **49*x* is inserted in the end 100 of the drive link 92, then the table is fastened to the drive link 92 at two points namely the opening 100 and the opening 99**. This eliminates the possibility of pivotal motion between the link and the table. As the crank pin revolves, therefore, the table will simply trace the motion of the rotary crank pin. During this mode, the fore-and-aft movement of the table is permitted by the first pair of links and the side-to-side movement is permitted by the second pair of links, each of which in use passes through a parallelogram-to-rectangle-to-parallelogram sequence and the reverse of that sequence.

Because the table is permitted by the universal joint mountings to undergo this motion without significant resistance, the shaker mode of the table is a rotary motion. During this operation, the end 88 of the leg extension 86 is free to swing through an arc relative to the table, as dictated by the motion of its two pivot points attached respectively to the leg 70 and the table by fastener 48.

When it is desired to provide a reciprocating shaking motion only, the shoulder screw **49*x* is removed from the opening 100 in the end 98 of the link 94, and placed through opening 49*b* into the tapped opening 90 in the end 88 of the leg extension 86. The result of this is that the leg 80 is affixed to the table 30 at two points, i.e., at the locus of the opening 47 and the opening 49*b*. This connection having resulted in freeing the end 98 of the drive link 92, connecting rod portion 94 of the link 92** is permitted to act in part as it would in an automotive connective rod, for example, pivoting at both its ends as the crank pin operates through its rotary cycle. Its free end swings through an arc.

In this mode, the rigid connection of the table 30, relative to the link 80 prevents the table from moving from side to side because a rigid, multi-point connection is made at points 90 and 47, and where the link ends 74, 76 joins the L-member 66. In other words, the link 78, 80 are not permitted to swing relative to the leg 70 and hence remain parallel to leg 68 of the idler plate. Since fore-and-aft motion is permitted because the legs 52, 54 are still free to swing about their pivot points, and because the leg extension 98 is free to swing through an arc, the rotary motion of the crank is translated exclusively into fore-and-aft shaker motion, as is desired according to the invention.

As was pointed out, this transition between modes is made by simply removing a thumb screw or the like from one opening and inserting it through another opening into a link end, thus tying the table to one mechanism or another and simultaneously releasing it.

With the combination of adjustable stroke, adjustable shaking speed and mode of operation in a simple, multi-link mechanism, highly advantageous and economical apparatus is provided.

In the above description, the expression "fore-and-aft" or "transverse" as applied to the motion means substantially although not absolutely fore-and-aft. Thus, there may be a slight left-to-right movement in a fore-and-aft motion, depending on the length of the movement stroke in relation to the angular deflection of the links. However, with the shaking distance being perhaps varying from a small fraction of an inch to perhaps only about an inch, with the links 52, 54 having a length of one foot or more, the side-to-side excursion relative to the fore-and-aft movement is very small.

Figure 6:
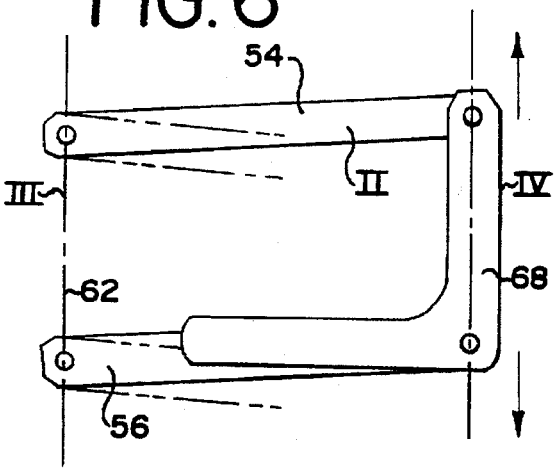
FIG. 6 is a plan view, partly diagrammatic in character, showing the motion of the first set of parallelogram links of the invention.

FIGS. 6–9 schematically show these modes of operation. In FIG. 6, the links of 52, 54 are designated as sides I and II, and the other sides formed by the locus lines 62 and the leg 68 form parallel sides III and IV. As these swing through an arc indicated in part by the dotted lines, the leg 66 of the member 66 stays parallel to the locus 62.

Figure 7:
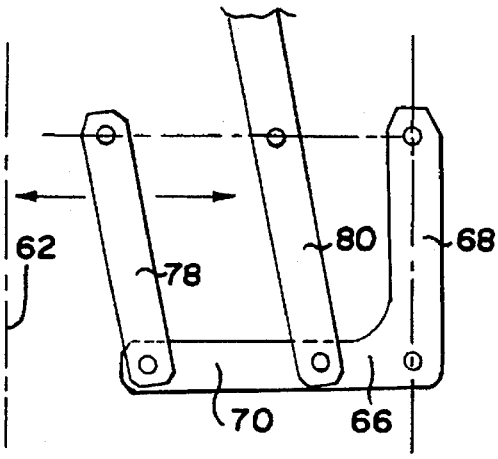
FIG. 7 is a plan view, also partially diagrammatic in nature, and showing the second set of parallelogram links of the invention.

FIG. 7 shows that because the L-member 68 has legs 68, 70 which do not move relative to each other, that leg 70 will remain perpendicular to the locus 62, just as leg 68 remains parallel to such locus. The links 78, 80 may swing through an arc without disturbing this relationship. Consequently, the table, which is affixed to links 78, 80 may swing from right to left as shown in FIG. 7, and counterpart portions of the table will always remain parallel to the leg 70.

Figure 8:
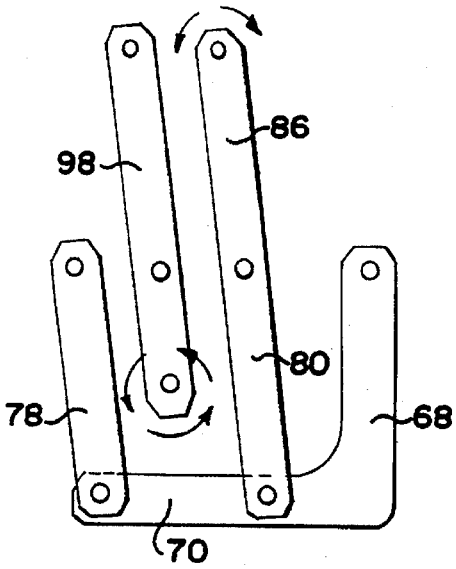
FIG. 8 is a plan view, somewhat diagrammatic in nature, and showing the apparatus with the drive link secured to the table in two areas, thus creating circular shaking motion in the table; and, FIG. 9 is a view similar to that of FIG. 8, but showing an extension of one link in the second parallelogram linkage secured to the table, thus causing an oscillating motion in the table.

FIG. 8 illustrates that where the extension 98 of the drive link 94 is fastened to the table as is the center portion of the link 94, there can be no pivoting of the table relative to the links 78, 80. The table will describe the same circular motion as the crank pin 24, because both sets of links can pivot.

Figure 9:
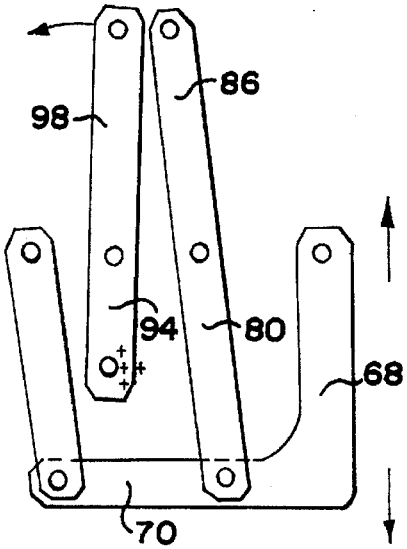

FIG. 9 is similar to that of FIG. 8 except that a rigid connection is made between the link 80 and the table. Then, only links 52, 54 may pivot, and since the drive link can pivot, the table moves fore-and-aft only.

It will thus be seen that the present invention provides a new and improved shaker apparatus having a number of advantages and characteristics including those pointed out herein and others which are inherent in the invention. A few preferred forms of the invention, having been described by way of example, it is anticipated that a number of modifications and variations to the described form of apparatus will occur to those skilled in the art and it is anticipated that such variations may be made without departing from the scope of the invention, or the spirit of the invention or the scope of the appended claims.

The invention claimed is:

1. A shaker table assembly comprising, in combination, a base unit, a shaker table positioned above said base unit by support legs permitting universal motion, a drive motor, a rotary crank pin element driven by said motor, and a movement control arrangement for said shaker table, said movement control arrangement comprising, in combination, first and second parallelogram linkages, said first parallelogram linkage having first and second links pivotally attached to said base at spaced apart points, defining a side of said parallelogram and also a first locus, and a common link having one portion joining said first and second links along a line lying parallel to and spaced from said first locus, said common link having another portion extending perpendicular to said first locus, and said second parallelogram linkage comprising said another portion of said common link, a pair of shaker table locating links extending from and pivotally joining points on said another portion of said common link to spaced apart portions of said shaker table, and a drive link having three portions, with one portion of said drive link being pivotally affixed to said crank pin element, a spaced apart second portion of said drive link being attached to said shaker table, and a third spaced apart portion of said drive link being detachably affixable to a portion of said shaker table, one of said shaker table locating links also having another portion to which said shaker table is removably attached, whereby, When said motor rotates said crank pin element, said drive link moves said second parallelogram linkage and said shaker table through one motion sequence when said drive link third portion is attached to said shaker table and another motion sequence when said another portion of said shaker table locating link is attached to said shaker table.

2. The shaker table assembly as defined in claim 1 wherein said common link is in the form of an L-member having one leg parallel to said first locus and another leg perpendicular to said first locus.

3. The shaker table assembly as defined in claim 1 wherein said motor is remotely positioned relative to said rotary crank pin element, and wherein said assembly further includes driving and driven sprockets connected by a positive drive type belt and said motor operatively drives said driving sprocket thereby rotating said rotary crank pin.

4. The shaker table assembly as defined in claim 1 wherein said rotary crank pin element comprises a rotary drive plate, a crank pin carrier, a pin disposed on said carrier and wherein said carrier and said drive plate are pivotally attached to each other by a mechanism permitting pivotal, swinging movement of said crank pin carrier about a peripheral point on said rotary drive plate to vary the position of said crank pin element relative to the center of said drive plate, said assembly further including means for releasably securing said crank pin carrier in a plurality of different positions to vary the operating stroke of said shaker table assembly.

5. The shaker table assembly as defined in claim 1 wherein said drive link is of a predetermined length, wherein said one portion pivotally affixed to said crank pin element lies at one end of said drive link, and said second portion attached to said table is positioned approximately centrally of said drive link and wherein said third spaced apart portion comprises a free end portion at the opposite end of said drive link.

6. The shaker table assembly as defined in claim 1 wherein said another portion of said shaker table locating link comprises a free end portion of said shaker table locating link.

7. The shaker table assembly as defined in claim 1 wherein said support legs permitting universal motion comprises four support legs, each having a ball and socket connection at each of its ends for supporting said table.

8. The shaker table assembly as defined in claim 1 wherein said drive motor is a variable speed drive motor.

9. A table locating and movement mode control mechanism comprising, in combination, first and second cooperating parallelogram linkages, said first parallelogram linkage having a pair of links each having a pivotable end and a swinging end, wherein said pivotable ends are attached to a reference surface at a pair of points spaced from each other and lying along a first locus, and a combination link unit having one leg connecting the swinging ends of said pair of links to complete said first parallelogram linkage, said combination link unit also having another leg for forming a part of said second parallelogram linkage, said second parallelogram linkage also including a second pair of links pivotably attached to said another leg at spaced apart points on said another leg, with each of said links in said second pair also having a portion pivotally attachable to an associated shaker table, with at least one of said second pair of links having another portion removably fastenable to said shaker table, and a drive arrangement comprising a drive link having three portions, wherein a first portion of said drive link is affixed to said table, a second portion of said drive link is engageable with a crank pin on a drive mechanism and a third portion of said drive link is removably affixable to said table, whereby affixing said third portion of said drive link to said shaker table will create one shaker table movement sequence and affixing said another portion of said one of said second pair of links to said shaker table will create a different shaker table movement sequence, when said crank pin is rotated by said drive mechanism.

10. The table locating and movement mode control mechanism as defined in claim 9 wherein said link including said removably fastenable portion is arranged such that said portion of said link that is pivotably attached to said shaker table lies between said removably fastenable portion and said point at which said link is pivotably attached to said another leg.

11. The table locating and movement mode control mechanism as defined in claim 9 wherein said first portion of said drive link lies between said second and third portions of said drive link.

* * * * *